US010173428B2

(12) United States Patent
Takekoshi et al.

(10) Patent No.: US 10,173,428 B2
(45) Date of Patent: Jan. 8, 2019

(54) LIQUID EJECTING APPARATUS AND CONTROL METHOD

(71) Applicant: SEIKO EPSON CORPORATION, Tokyo (JP)

(72) Inventors: Taro Takekoshi, Shiojiri (JP); Shunichi Hizawa, Matsumoto (JP); Seiji Tojo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/690,019

(22) Filed: Aug. 29, 2017

(65) Prior Publication Data

US 2018/0065372 A1 Mar. 8, 2018

(30) Foreign Application Priority Data

Sep. 8, 2016 (JP) ..... 2016-175294

(51) Int. Cl.

| | |
|---|---|
| ***B41J 2/165*** | (2006.01) |
| ***B41J 2/045*** | (2006.01) |
| ***B41J 29/02*** | (2006.01) |
| ***B41J 29/13*** | (2006.01) |
| ***B41J 29/377*** | (2006.01) |

(52) U.S. Cl.

CPC ..... *B41J 2/16526* (2013.01); *B41J 2/04586* (2013.01); *B41J 2/16508* (2013.01); *B41J 2/16511* (2013.01); *B41J 2/16532* (2013.01); *B41J 29/02* (2013.01); *B41J 29/13* (2013.01); *B41J 29/377* (2013.01)

(58) Field of Classification Search

CPC ..... B41J 2/16526; B41J 2/16532; B41J 2/16511; B41J 2/16508; B41J 2/04586

See application file for complete search history.

(56) References Cited

U.S. PATENT DOCUMENTS

2004/0070641 A1 4/2004 Inoue
2008/0180500 A1* 7/2008 Sugahara ..... B41J 2/14233 347/93

FOREIGN PATENT DOCUMENTS

| | | |
|---|---|---|
| JP | 10-006531 | 1/1998 |
| JP | 10-202903 | 8/1998 |
| JP | 2004-122761 | 4/2004 |
| JP | 2007-301906 | 11/2007 |
| JP | 2015-155165 | 8/2015 |

* cited by examiner

*Primary Examiner* — Sharon A Polk
(74) *Attorney, Agent, or Firm* — Workman Nydegger

(57) ABSTRACT

A liquid ejecting apparatus includes a liquid ejecting head that ejects a liquid to a medium transported along a transport path, a suction mechanism that sucks an interior of the liquid ejecting head, an atmospheric pressure detection unit that has a vent for communication with an atmosphere and that detects atmospheric pressure, and a control unit that controls operation of the suction mechanism on the basis of a value of atmospheric pressure detected by the atmospheric pressure detection unit. The atmospheric pressure detection unit is disposed at a location that is outside the transport path and that is higher than the transport path.

14 Claims, 6 Drawing Sheets

LIQUID EJECTING APPARATUS AND CONTROL METHOD

BACKGROUND

1. Technical Field

The present invention relates to a liquid ejecting apparatus such as a printer.

2. Related Art

There have existed liquid ejecting apparatuses that, at the time of performing a maintenance operation of sucking the interior of a liquid ejecting head that ejects a liquid, change conditions for the sucking operation according to the atmospheric pressure at the place of use (e.g., JP-A-2007-301906).

In the case where a sensor employed in such an apparatus to detect atmospheric pressure uses atmospheric pressure, the inside of the sensor needs to be open to the atmosphere. However, this leads to a problem that the atmospheric air may well bring into the sensor undesirable matter, such as dust and dirt or a mist of small liquid droplets, which makes it impossible to correctly detect the atmospheric pressure.

SUMMARY

An advantage of some aspects of the invention is that a liquid ejecting apparatus capable of reducing the influence of undesirable matter on atmospheric pressure detection is provided.

An aspect of the invention provides an ejecting apparatus that includes a liquid ejecting head that performs recording by ejecting a liquid to a medium transported along a transport path, a suction mechanism that sucks an interior of the liquid ejecting head, an atmospheric pressure detection unit that has a vent for communication with an atmosphere and that detects atmospheric pressure, and a control unit that controls operation of the suction mechanism based on a value of atmospheric pressure detected by the atmospheric pressure detection unit. The atmospheric pressure detection unit is disposed at a location that is outside the transport path and that is higher than the transport path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the liquid ejecting apparatus of the invention will be described hereinafter with reference to the drawings. The liquid ejecting apparatus is, for example, an ink jet type printer that performs recording (printing) by ejecting ink, an example of a liquid, to a medium such as a sheet of paper.

First Exemplary Embodiment

Figure 1:
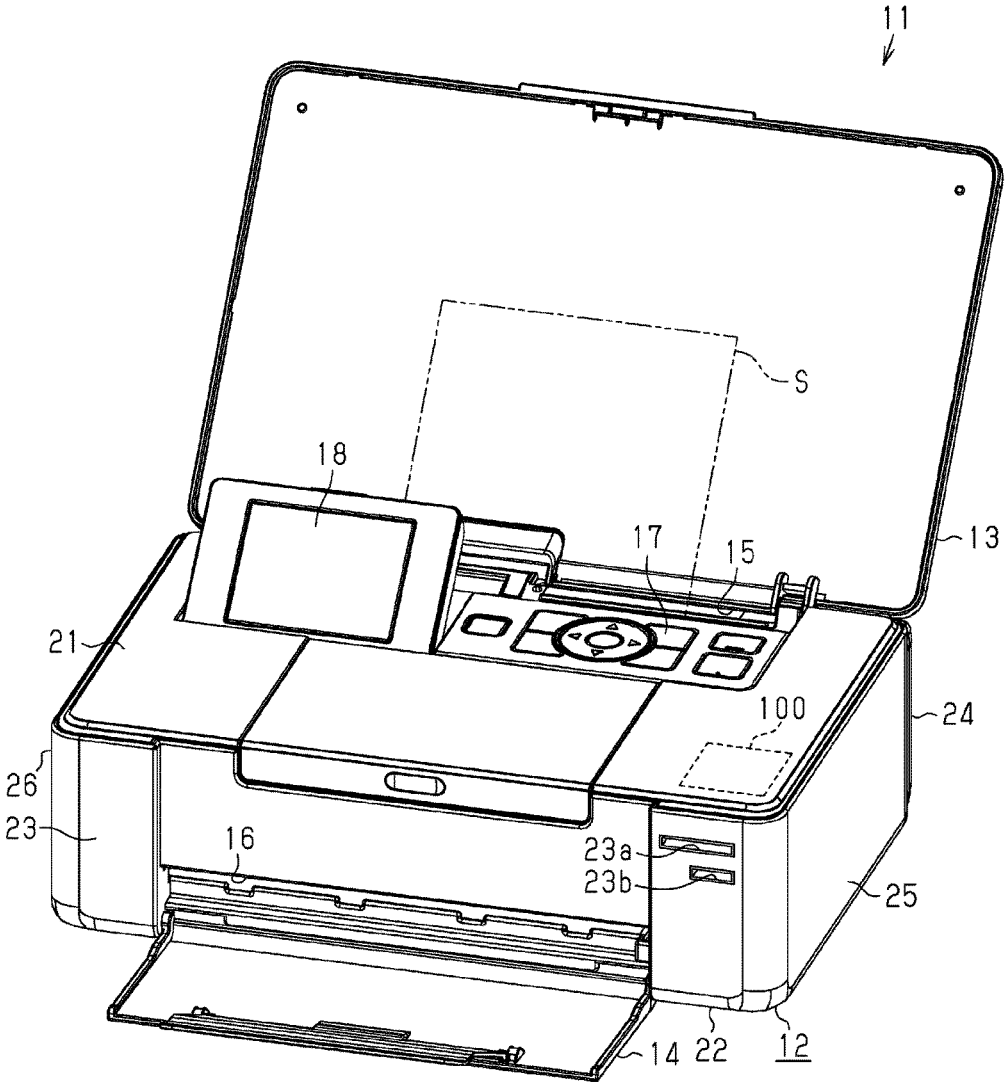
FIG. 1 is a perspective view illustrating a first exemplary embodiment of the liquid ejecting apparatus of the invention.

As illustrated in FIG. 1, a liquid ejecting apparatus 11 of a first exemplary embodiment includes a box-shaped casing 12, an upper lid 13 attached pivotably to the casing 12, and a front lid 14 also attached pivotably to the casing 12. The upper lid 13 and the front lid 14 are each pivoted to predetermined angles to assume a closed position at which the lid is substantially flush with the casing 12 and an open position as shown in FIG. 1.

The casing 12 has a introducing port 15 through which a medium S is fed and a discharging port 16 through which the medium S is discharged. The introducing port 15 is exposed when the upper lid 13 is positioned in the open position. When positioned in the open position, the upper lid 13 supports the medium S inserted into the introducing port 15. The discharging port 16 is exposed when the front lid 14 is positioned in the open position. When positioned in the open position, the front lid 14 receives the medium S discharged through the discharging port 16.

In the casing 12, an outside wall in which the introducing port 15 has an opening is referred to as "upper wall 21", an outside wall disposed substantially in parallel with the upper wall 21 is referred to as "bottom wall 22", an outside wall in which the discharging port 16 has an opening is referred to as "front wall 23", and an outside wall disposed substantially in parallel with the front wall 23 is referred to as "rear wall 24". Furthermore, in the casing 12, two opposite outside walls that extend in directions intersecting the upper wall 21, the bottom wall 22, the front wall 23, and the rear wall 24 are referred to as "side walls 25 and 26". With regard to the casing 12, an upper wall 21 will sometimes be referred to as "top surface side" and a bottom wall 22 side will sometimes be referred to as "bottom surface side".

An obverse surface side (top surface side) of the upper wall 21 is provided with an operation unit 17 for operating the liquid ejecting apparatus 11 and a display unit 18 for displaying results of operations of the operation unit 17, operation situations of the liquid ejecting apparatus 11, etc.

The front wall 23 may have, for example, at a location near the upper wall 21 and the side wall 25, a card slot 23*a* for inserting a card-shaped storage medium that stores information such as image data, a insertion port 23*b* into which a connector of a USB cable or the like for sending and receiving information is inserted, etc.

A reverse surface side of the upper wall 21 has, at a location near the front wall 23 and the side wall 25, a control unit 100 designed on a circuit substrate so as to control various mechanisms provided in the liquid ejecting apparatus 11.

Figure 2:
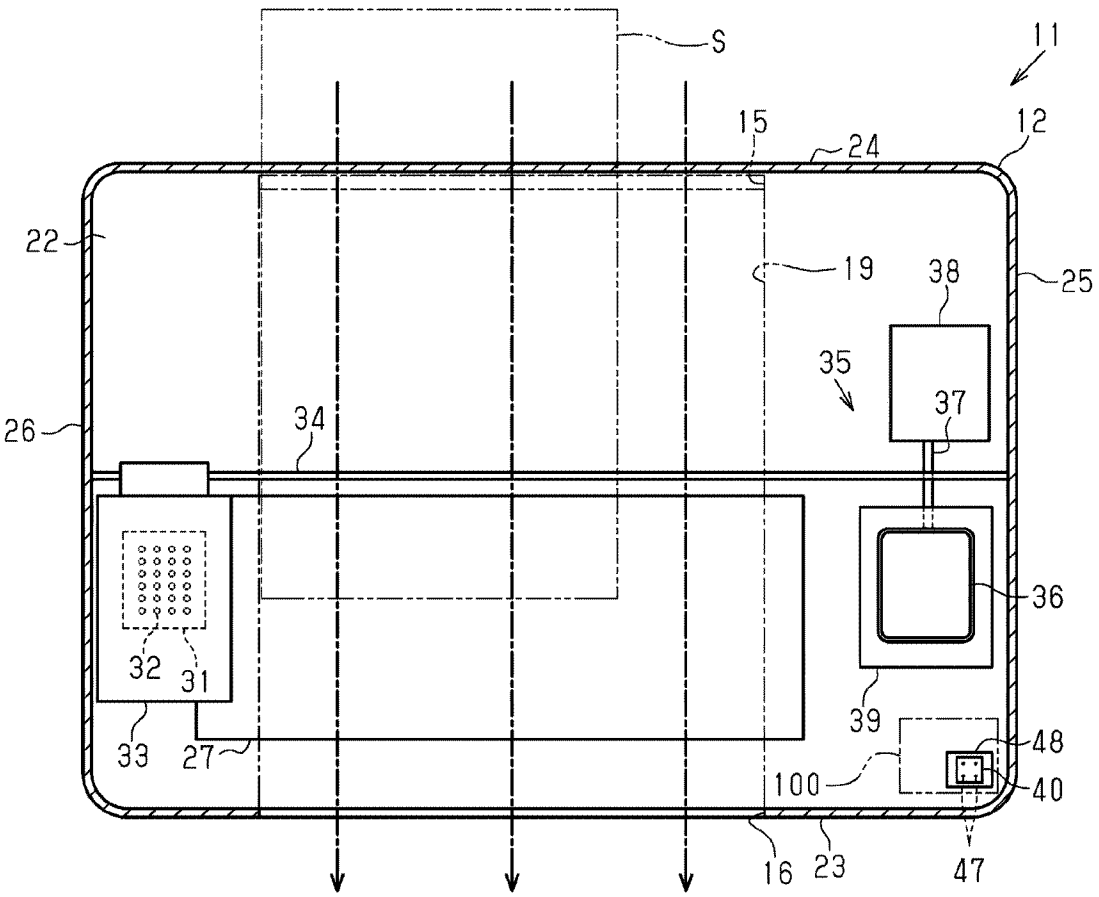
FIG. 2 is a schematic diagram illustrating a plan view of an internal configuration of the liquid ejecting apparatus shown in FIG. 1.

Inside the casing 12, as illustrated in FIG. 2, there are disposed a transport path 19 extending from the introducing port 15 toward the discharging port 16, a support member 27 that supports the medium S that is transported along the transport path 19, a liquid ejecting head 31 that performs recording by ejecting a liquid to the medium S supported by the support member 27, and a carriage 33 that firmly holds the liquid ejecting head 31 and moves back and forth. Inside the casing 12, a guide shaft 34 for guiding movement of the carriage 33 is suspended.

The liquid ejecting apparatus 11 further includes an atmospheric pressure detection unit 40 that detects the atmospheric pressure (absolute pressure), for example, at a location near the control unit 100 made up of a circuit substrate. The atmospheric pressure detection unit 40 is disposed at a location that is outside of the transport path 19 in the casing 12 and that is higher than the transport path 19.

The liquid ejecting head 31 has a plurality of nozzles 32 that eject the liquid in the form of droplets. The liquid ejecting head 31 rests at a home position that is at a first end side (a right end side in FIG. 2) in a longitudinal direction of the casing 12 (a left-right direction in FIG. 2) and, when in operation, alternately undergoes an outward movement from the home position to a second end side in the longitudinal direction (to a left end side in FIG. 2) and a homeward movement from the second end side to the home position.

In conjunction with the exemplary embodiment, the direction in which the liquid ejecting head 31 ejects the liquid is referred to as "ejection direction", the direction in which the medium S is transported over the support member 27 from the introducing port 15 toward the discharging port 16 is referred to as "transport direction", and the direction of outward movement of the liquid ejecting head 31 from the home position is referred to as "scanning direction". In this exemplary embodiment, the ejection direction is vertically downward.

Near the home position inside the casing 12 there is disposed a maintenance mechanism 35 for performing maintenance of the liquid ejecting head 31. The maintenance mechanism 35 includes a cap 36 disposed at a position that corresponds to the home position, a suction mechanism 38 connected to the cap 36 via a suction tube 37, and an elevation mechanism 39 that moves the cap 36 upward and downward.

The elevation mechanism 39 moves the cap 36 between a capping position and a withdrawn position that is nearer to the bottom wall 22 than the capping position is. As the cap 36 is moved to the capping position when the liquid ejecting head 31 is at the home position, the cap 36 forms a closed space to which the nozzles 32 are open, so that the drying of the nozzles 32 is inhibited.

The cap 36 forming a closed space to which the nozzles 32 are open is referred to as "capping". When the liquid is not ejected, for example, when electric power supply is off, the liquid ejecting head 31 is moved to the home position and the cap 36 is moved to the capping position to carry out the capping. When the cap 36 is moved from the capping position to the withdrawn position, the capping discontinues.

The suction mechanism 38 is, for example, a suction pump made up of, for instance, a tube pump that generates suction force by causing a pressing member to move along an elastically deformable tube and squeeze the tube. When the suction mechanism 38 is operated during a capped state made by the cap 36, the closed space is depressurized to a negative pressure. This carries out a suction cleaning operation in which the liquid is expelled from the liquid ejecting head 31 through the nozzles 32.

The suction cleaning operation of sucking the liquid from inside the liquid ejecting head 31 through the use of the suction mechanism 38 is performed as a maintenance operation for eliminating incomplete ejection of the liquid, for example, when incomplete ejection results from entry of bubbles into the liquid ejecting head 31. Another maintenance operation for eliminating incomplete ejection is carried out in some cases by performing a flushing operation in which the liquid ejecting head 31 thrusts droplets out toward the cap 36 positioned at the withdrawn position.

Next, a configuration of the atmospheric pressure detection unit 40 will be described in detail.

Figure 3:
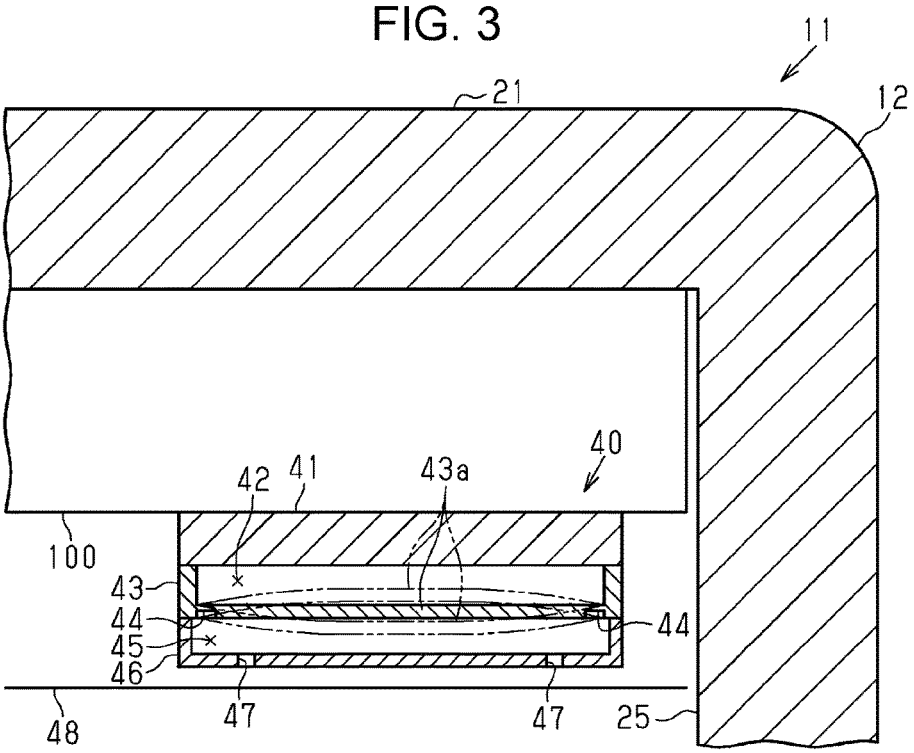
FIG. 3 is a sectional view schematically illustrating an atmospheric pressure detection unit provided in the liquid ejecting apparatus shown in FIG. 1.

As illustrated in FIG. 3, the atmospheric pressure detection unit 40 includes a substrate 41 and a displacement layer 43 that, together with the substrate 41, forms a vacuum hollow portion 42. A portion of the displacement layer 43 which faces the hollow portion 42 is thin, forming a displacement portion 43*a* that is flexibly displaceable.

The atmospheric pressure detection unit 40 includes a sensor 44 that detects displacement of the displacement portion 43*a* and a ventilation layer 46 that, together with the displacement portion 43*a*, forms a space portion 45 that is separated from the hollow portion 42. The ventilation layer 46 has one or a plurality of (four, in this exemplary embodiment) vents 47 that provide communication between the space portion 45 and the atmosphere.

The sensor 44 is, for example, a strain gauge. When the pressure (atmospheric pressure) in the space portion 45 in communication with the atmosphere through the vents 47 changes to produce a pressure difference from the pressure in the hollow portion 42, the displacement portion 43*a* is flexibly displaced as indicated by two-dot chain lines in FIG. 3. Then, the sensor 44 detects the displacement of the displacement portion 43*a* and the atmospheric pressure detection unit 40 converts the displacement into an atmospheric pressure value and outputs the value to the control unit 100.

It is preferable that the atmospheric pressure detection unit 40 be disposed so that the vents 47 have their openings facing toward the outside of the transport path 19, as illustrated in FIG. 2. The openings of the vents 47 of the atmospheric pressure detection unit 40 face toward the outside of the transport path 19, for example, in an arrangement in which the atmospheric pressure detection unit 40 is disposed on the lower surface of the circuit substrate forming the control unit 100 in such a manner that the openings of the vents 47 face downward. Furthermore, it is preferable that the atmospheric pressure detection unit 40 be disposed at a location that is nearer to the discharging port 16 than to the introducing port 15.

Furthermore, in the case, for example, where the casing 12 has, below the atmospheric pressure detection unit 40, openings such as a card slot 23*a* (see FIG. 1) and a insertion port 23*b* (see FIG. 1), it is preferable to provide a film-shaped cover 48 that covers the vent 47 side of the atmospheric pressure detection unit 40.

Next, control performed by the control unit 100 will be described.

The control unit 100 controls the operation of the suction mechanism 38 on the basis of the value of atmospheric pressure detected by the atmospheric pressure detection unit 40.

Note that, in order to expel undesirable matter, such as bubble, that has entered the liquid ejecting head 31, suction needs to be performed so that the liquid will flows in an amount of flow that is greater than or equal to a predetermined amount and also note that the time taken for the amount of flow through the suction mechanism 38 to reach that predetermined value after the suction mechanism 38 starts to be operated differs depending on the atmospheric pressure (absolute pressure).

Furthermore, the atmospheric pressure (absolute pressure) changes according to altitude. For example, the atmospheric pressure at an altitude of 0 m (meter) is 1013 hPa, the atmospheric pressure at an altitude of 1000 m is 894 hPa, the atmospheric pressure at an altitude of 2000 m is 789 hPa, and the atmospheric pressure at an altitude of 3000 m is 696 hPa. Therefore, when the suction cleaning is performed in places at different altitudes, the effect of suction sometimes varies.

Figure 4:
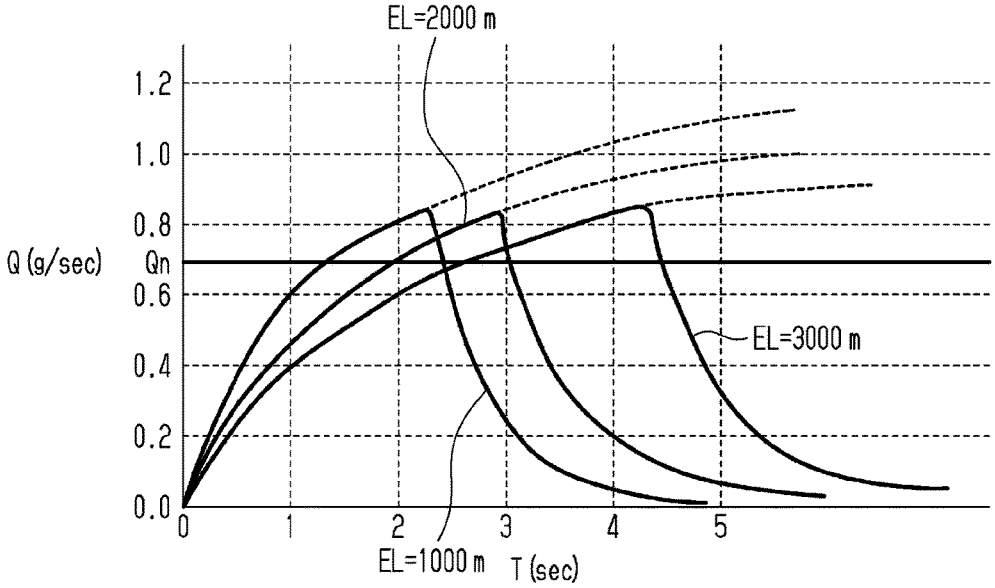
FIG. 4 is a graph illustrating a relation between suction characteristic of a suction mechanism and the altitude.

For example, as indicated in FIG. 4, while the suction operation in a place at an altitude EL of 1000 m achieves a flow amount value Qn needed in order to expel bubbles in a time of about 1.5 seconds after the suction starts, the suction operation in a place at an altitude EL of 2000 m takes about 2 seconds to achieve that flow amount value Qn and the suction operation in a place at an altitude EL of 3000 m takes about 2.5 seconds to achieve that flow amount value Qn.

Therefore, as for the suction cleaning, if the operating time of the suction mechanism 38 is fixed regardless of the place of use or the situation of use, insufficient expelling of bubbles may possibly occur in a place at high altitude or a situation at low atmospheric pressure and excessive consumption of the liquid may possibly occur in a place of low altitude or a situation at high atmospheric pressure.

Therefore, it is appropriate that the control unit 100 read out a value of atmospheric pressure detected by the atmospheric pressure detection unit 40 when the electric power supply is on or the like and, on the basis of the value of atmospheric pressure, change the operating time of the suction mechanism 38. The timing at which the control unit 100 reads out a value of atmospheric pressure may be set arbitrarily by a user or set so that the control unit 100 reads out a value of atmospheric pressure every time suction cleaning is performed. However, it is preferable that the control unit 100 read out a value of atmospheric pressure when the liquid ejecting apparatus 11 is not moving the carriage 33 or not performing liquid ejection, suction cleaning, or the like.

Next, operations and effects of the liquid ejecting apparatus 11 of this exemplary embodiment will be described.

As the medium S is transported over the transport path 19, dust, dirt, etc. accumulated on the transport path 19 fly off. Furthermore, when the medium S is a sheet of paper, paper powder adhering to ends or the like of the sheet of paper may sometimes fly off during transport. Still further, in a region in which the transport path 19 of the medium S intersects the movement path of the liquid ejecting head 31, small mist particles are produced as the liquid is ejected from the liquid ejecting head 31.

When undesirable matter, such as dust and dirt or mist, adheres to one or more of the vents 47 of the atmospheric pressure detection unit 40, those vents 47 may be clogged, impeding entry of external air into the space portion 45, so that the atmospheric pressure cannot be correctly detected.

However, in the arrangement in which the atmospheric pressure detection unit 40 is disposed outside the transport path 19, the vents 47 are less likely to be exposed to undesirable matter such as dust and dirt that fly off due to transport of the medium S or mist that is produced due to liquid ejection. Furthermore, in the arrangement in which the atmospheric pressure detection unit 40 is disposed at a location higher than the transport path 19, undesirable matter falling due to its own weight is unlikely to adhere to any of the vents 47. Still further, the disposal of the atmospheric pressure detection unit 40 with the openings of the vents 47 facing downward allows undesirable matter temporarily adhering to a vent 47 to sometimes fall and therefore reduces or inhibits fixture of undesirable matter to the vents 47.

Furthermore, in some cases, through various openings provided in the casing 12, such as the introducing port 15, the discharging port 16, the card slot 23*a*, and the insertion port 23*b*, undesirable matter present outside the casing 12, such as dust and dirt, enters the casing 12. Particularly, when the liquid ejecting apparatus 11 is used outdoors, increased amounts of undesirable matter enter the casing 12.

In this exemplary embodiment, however, since the atmospheric pressure detection unit 40 is disposed at a location apart from the introducing port 15 formed in a rear portion of the upper wall 21 and also apart from the discharging port 16 formed in a lower portion of the front wall 23 (the location being near a corner portion where the upper wall 21, the front wall 23, and the side wall 25 meet), undesirable matter having entered from outside is less likely to adhere to any of the vents 47.

Furthermore, in the arrangement in which openings, such as the card slot 23*a* and the insertion port 23*b*, are located in the direction in which the openings of the vents 47 of the atmospheric pressure detection unit 40 face (the downward direction in this exemplary embodiment), the cover 48 disposed between these openings and the vents 47 blocks undesirable matter from flowing in from the openings.

Note that, in the introducing port 15, airflow occurs as the medium S moves into the casing 12, so that such airflow through the introducing port 15 sometimes brings in undesirable matter. On the other hand, the discharging port 16, as indicated by one-dot chain lines in FIG. 2, serves also as an outlet for airflow that moves along the transport path 19 from the introducing port 15 due to transport of the medium S and therefore as an outlet for undesirable matter floating inside the casing 12. Therefore, disposing the atmospheric pressure detection unit 40 at a location that is nearer to the discharging port 16 than to the introducing port 15 makes it less likely that undesirable matter coming in through the introducing port 15 will adhere to the vents 47 and makes it feasible for undesirable matter adhering to or near the vents 47 to be removed by airflow.

The foregoing exemplary embodiment can achieve advantageous effects as follows.

(1) Since the atmospheric pressure detection unit 40 is disposed outside the transport path 19, undesirable matter, such as mist of small particles produced due to ejection of the liquid and dust and dirt that fly off due to transport of the medium S, is less likely to adhere to any of the vents 47. Therefore, the influence of undesirable matter on atmospheric pressure detection can be reduced.

(2) Since the atmospheric pressure detection unit 40 is disposed so that the openings of the vents 47 face toward the outside of the transport path 19, undesirable matter that flies outward from the transport path 19 is less likely to enter any of the vents 47. Therefore, the influence of undesirable matter on atmospheric pressure detection can be reduced.

(3) Even when airflow that moves from the introducing port 15 toward the discharging port 16 during transport of the medium S brings in undesirable matter through the introducing port 15, the undesirable matter is less likely to adhere to any of the vents 47 since the atmospheric pressure detection unit 40 is disposed near the discharging port 16. Furthermore, undesirable matter adhering to the atmospheric pressure detection unit 40 can be removed by airflow moving out of the casing 12 through the discharging port 16.

(4) Since the atmospheric pressure detection unit 40 is disposed in such a posture that the openings of the vent 47 face downward, falling undesirable matter is less likely to adhere to any of the vents 47. Furthermore, since undesirable matter adhering to or near the vents 47 can sometimes fall, fixture of undesirable matter to the vents 47 is inhibited.

(5) Since the cover 48 covering the atmospheric pressure detection unit 40 blocks undesirable matter, adhesion of undesirable matter to the vents 47 is inhibited.

(6) The control unit 100 changes the operating time of the suction mechanism 38 on the basis of the value of atmospheric pressure detected by the atmospheric pressure detection unit 40, so that suction can be appropriately performed according to the atmospheric pressure at the time of use.

Second Exemplary Embodiment

Next, a second exemplary embodiment of the liquid ejecting apparatus 11 will be described with reference to FIG. 5 and FIG. 6.

As for the second exemplary embodiment, components and the like designated by the same reference characters as in the first exemplary embodiment have substantially the same constructions as in the first exemplary embodiment and therefore will be omitted from description, that is, the following description will mainly focus on differences from the first exemplary embodiment.

Figure 5:
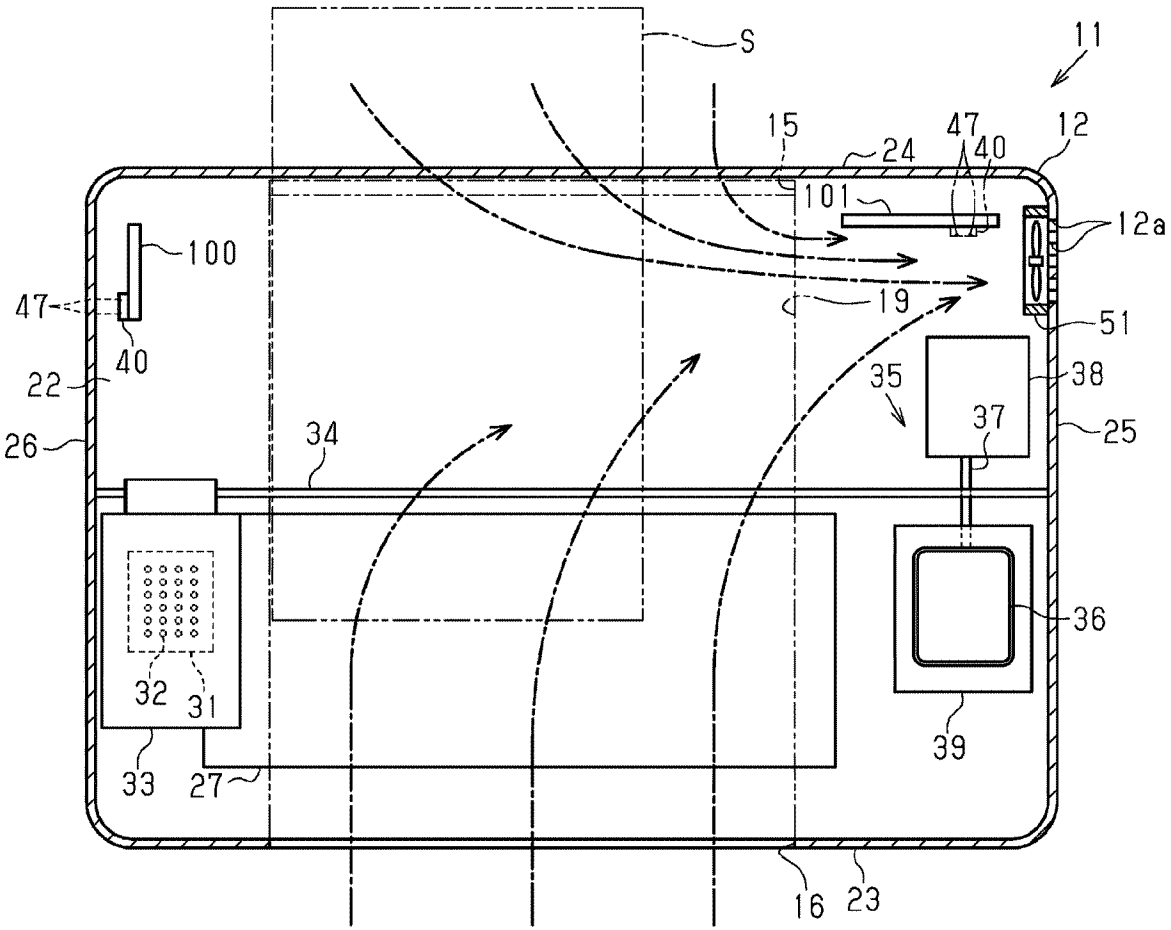
FIG. 5 is a schematic diagram illustrating a plan view of an internal configuration of a second exemplary embodiment of the liquid ejecting apparatus of the invention.

As illustrated in FIG. 5, a casing 12 of a liquid ejecting apparatus 11 of this exemplary embodiment is provided with a side wall 25 that has an exhaust opening 12*a*. The side wall 25 is opposite to a side wall 26. Furthermore, inside the casing 12 housing a liquid ejecting head 31 and an atmospheric pressure detection unit 40, an exhaust fan 51 is provided at a location to an inner side of the exhaust opening 12*a*. The exhaust fan 51 is used, for example, to cool the electric power supply circuit 101. The exhaust fan 51 blows out a gas from inside the casing 12 into the outside of the casing 12 through the exhaust opening 12*a*.

It is preferable that, within the casing 12, the atmospheric pressure detection unit 40 be disposed at a location that is farther apart from the exhaust opening 12*a* than the exhaust fan 51 is. Due to this arrangement, when the exhaust fan 51 is not in operation, undesirable matter entering the casing 12 through the exhaust opening 12*a* is less likely to adhere to any of vents 47.

Note that, in an arrangement in which the atmospheric pressure detection unit 40 is disposed at an air inlet side of the exhaust fan 51 (i.e., at a location indicated by two-dot chain lines in FIG. 5), undesirable matter adhering to the atmospheric pressure detection unit 40 and the vicinity thereof can be removed by operating the exhaust fan 51.

Furthermore, the exhaust opening 12*a* and the exhaust fan 51 may be disposed at the opposite side (the right side in FIG. 5) of the transport path 19 to the atmospheric pressure detection unit 40 (disposed at the left side in FIG. 5). For example, the atmospheric pressure detection unit 40 is disposed together with the control unit 100 at a location near the side wall 26 as indicated by a solid line in FIG. 5. In this case, the atmospheric pressure detection unit 40 is disposed between the side wall 26 and the control unit 100 and the atmospheric pressure detection unit 40 is disposed in such a posture that the openings of the vents 47 face toward the side wall 26. In this arrangement, the openings of the vents 47 faces toward the outside of the transport path 19.

When the exhaust fan 51 is operated, gas flows in through the introducing port 15 and the discharging port 16 and flows toward the exhaust opening 12*a* as indicated by one-dot chain line arrows in FIG. 5. Therefore, the atmospheric pressure detection unit 40 disposed at the opposite side of the transport path 19 to the exhaust opening 12*a* is located in an area in which airflow is unlikely to occur, so that undesirable matter moving with the airflow is less likely to adhere to the vents 47 and the atmospheric pressure detection unit 40 is less likely to produce false detection of the atmospheric pressure due to pressure changes caused by airflow.

In the case where a large amount of undesirable matter flows into the casing 12 from outside, the atmospheric pressure detection unit 40 may be disposed at a location as indicated by solid lines in FIG. 5. In the case where, a large amount of undesirable matter is present within the casing 12, the atmospheric pressure detection unit 40 may be disposed at a location as indicated by a two-dot chain line FIG. 5.

Figure 6:
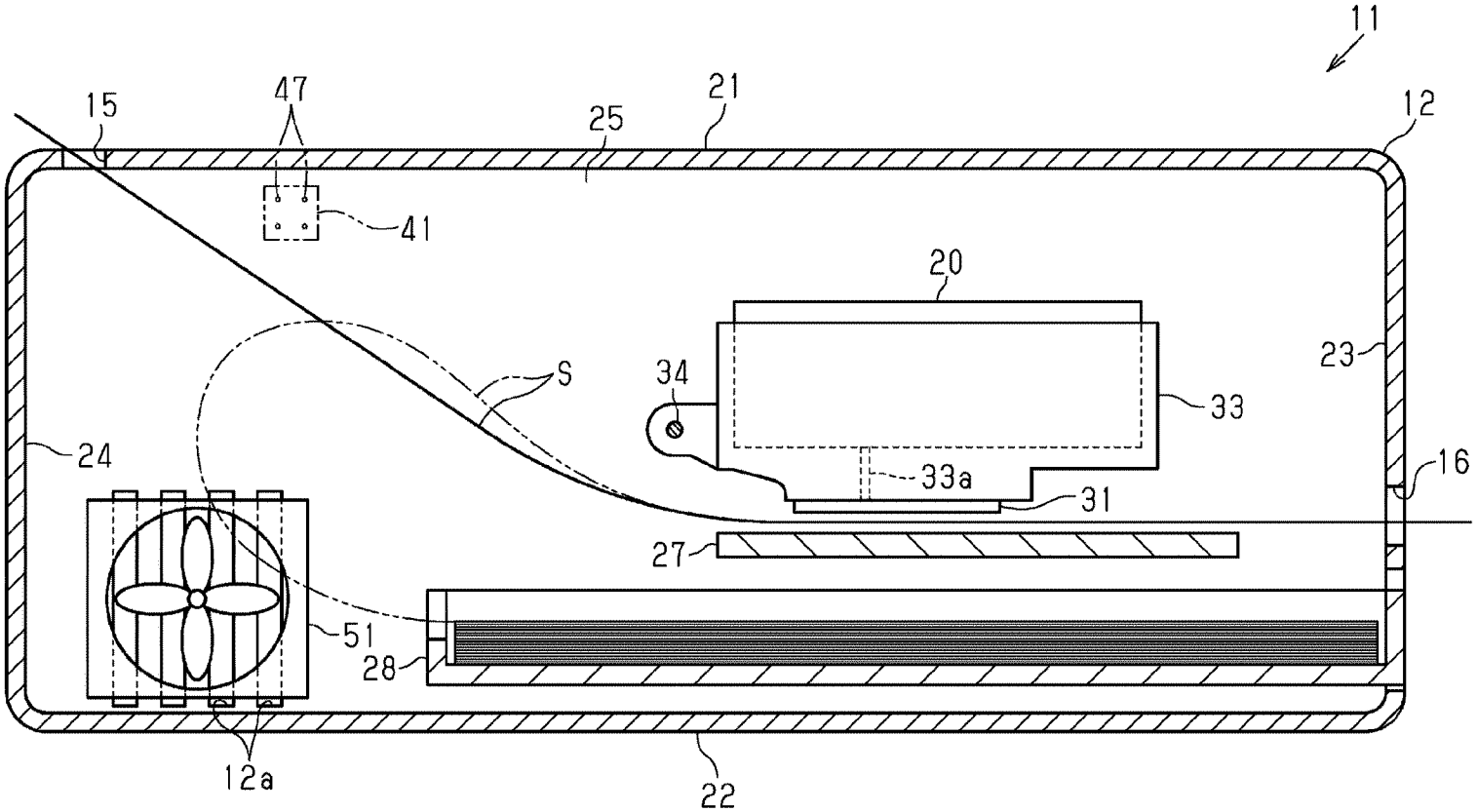
FIG. 6 is a schematic diagram illustrating a side view of an internal configuration of the liquid ejecting apparatus shown in FIG. 5.

As illustrated in FIG. 6, a cassette 28 that houses a plurality of sheet-shaped media S may be detachably set within the casing 12 and the media S may be fed from the cassette 28 one sheet at a time. In this case, it is preferable that the atmospheric pressure detection unit 40 be disposed above the cassette 28 and above a curved transport path (indicated by a two-dot chain line in FIG. 6) of a medium S fed from the cassette 28, because dust and dirt or the like flying off from the cassette 28 or from the transport path will less likely adhere to the atmospheric pressure detection unit 40.

Furthermore, a liquid container 20 that contains a liquid may be attached to the carriage 33 and the liquid contained in the liquid container 20 may be supplied to the liquid ejecting head 31 through a flow path 33*a* provided in the carriage 33. In this case, it is preferable that the atmospheric pressure detection unit 40 be disposed above the liquid container 20 and the flow path 33*a*, because even if the liquid should leaks from the liquid container 20 or the flow path 33*a*, the liquid leaking therefrom will less likely adhere to the atmospheric pressure detection unit 40.

This exemplary embodiment achieves, in addition to the advantages effects (1), (2), and (6) mentioned above, advantageous effects as follows.

(7) In the arrangement in which the atmospheric pressure detection unit 40 is disposed at a location apart from the exhaust opening 12*a*, undesirable matter that enters the casing 12 through the exhaust opening 12*a* when the exhaust fan 51 is not in operation is less likely to adhere to any of the vents 47. Furthermore, in the case where the atmospheric pressure detection unit 40 is disposed at the air inlet side of the exhaust fan 51, undesirable matter adhering to the atmospheric pressure detection unit 40 and to the surroundings thereof can be removed by operating the exhaust fan 51.

(8) When gas drawn into the casing 12 through the introducing port 15 and the discharging port 16 by operating the exhaust fan 51 is sent out through the exhaust opening 12*a*, airflow moving from the introducing port 15 and the discharging port 16 toward the vents 47 occurs in an area in the casing 12 which is at the side of the transport path 19 at which the exhaust opening 12*a* is provided. Therefore, the atmospheric pressure detection unit 40, which is disposed at the opposite side of the transport path 19 at which this airflow does not occur, is less subject to influence of undesirable matter contained in external air and also less subject to influence of pressure changes caused by airflow.

The foregoing exemplary embodiments may be modified as in the following modifications. Furthermore, constructions included in the foregoing exemplary embodiments may arbitrarily be combined with constructions included in the following modifications and constructions included in the following modifications may arbitrarily be combined with each other. Note that, in the following description, too, components and the like that have substantially the same functions as the components and the like described above will be designated by the same reference characters and redundant descriptions will be avoided.

Figure 7:
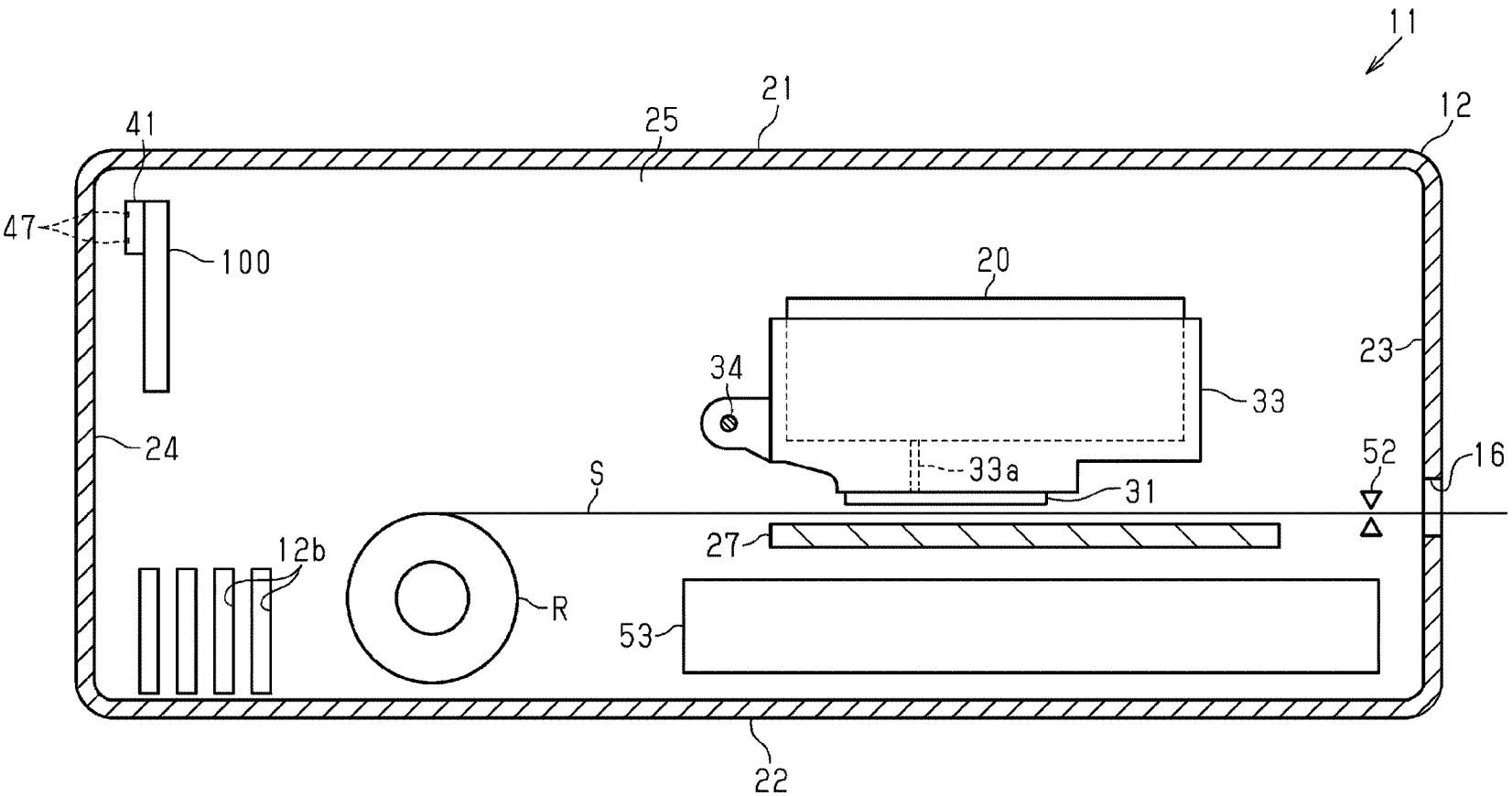
FIG. 7 is a schematic diagram illustrating a modification of the liquid ejecting apparatus.

As in a modification illustrated in FIG. 7, a medium S before being used may be housed within the casing 12 as a rolled-up roll body R of the medium S. In this case, a cutter 52 for cutting the medium S after recording into a predetermined length may be provided near the discharging port 16. Furthermore, in this case, the casing 12 does not need to have the introducing port 15.

As in the modification illustrated in FIG. 7, a waste liquid container 53 for containing a waste liquid expelled due to suction cleaning and flushing may be disposed below the support member 27. In this case, it is preferable that the atmospheric pressure detection unit 40 be disposed above the liquid container 20, the flow path 33*a*, and the waste liquid container 53, because even if the liquid or the waste liquid should leak from the liquid container 20, the flow path 33*a*, or the waste liquid container 53, the liquid or waste liquid having leaked will less likely adhere to the atmospheric pressure detection unit 40.

As in the modification illustrated in FIG. 7, the control unit 100 may be disposed along the rear wall 24 and the atmospheric pressure detection unit 40 may be disposed between the rear wall 24 and the control unit 100. In this case, it is preferable that the atmospheric pressure detection unit 40 be disposed in such a posture that the openings of the vents 47 face the rear wall 24. According to this construction, since the atmospheric pressure detection unit 40 is disposed at a location apart from the discharging port 16, undesirable matter that flows into the casing 12 through the discharging port 16 is less likely to adhere to any of the vents 47.

As in the modification illustrated in FIG. 7, the casing 12 (e.g., the side wall 25 thereof) may be provided with a heat radiating opening 12*b*. In this case, the exhaust fan 51 (see FIG. 6) does not need to be provided near the heat radiating opening 12*b*. In the case where the casing 12 is provided with openings such as the heat radiating opening 12*b* and the discharging port 16 as illustrated in FIG. 7, it is preferable that the posture of the atmospheric pressure detection unit 40 be set so that the openings of the vents 47 face in a direction different from the facing directions of the openings such as the heat radiating opening 12*b* and the discharging port 16, because undesirable matter entering through the openings is less likely to adhere to any of the vents 47. Furthermore, in the case where the casing 12 is provided with a plurality of openings, if it is not easy to direct the vents 47 in a direction different from the facing directions of all the openings, it is advisable that the facing direction of the vents 47 be set so that the vents 47 do not face an opening whose opening area is particularly large or an opening, such as the introducing port 15, which undesirable matter easily enters.

The liquid that the liquid ejecting head 31 ejects is not limited to ink but may also be, for example, a liquid material in which particles of a functional material are dispersed or mixed. For example, the liquid ejecting apparatus 11 may be configured to perform recording by ejecting a liquid material that contains in the form of a dispersion or solution of a material, such as an electrode material or a color material (pixel material), that is used in manufacturing liquid crystal displays, electroluminescence (EL) displays, surface emitting displays, etc.

The medium S is not limited to a sheet of paper but may also be a plastic film, a thin plate member, etc., and may also be a cloth for use in a textile printing apparatus.

Technical ideas and their operations and effects conceivable from the foregoing exemplary embodiments and modifications will be mentioned below.

Technical Idea 1

An ejecting apparatus including a liquid ejecting head that performs recording by ejecting a liquid to a medium transported along a transport path, a suction mechanism that sucks an interior of the liquid ejecting head, an atmospheric pressure detection unit that has a vent for communication with an atmosphere and that detects atmospheric pressure, and a control unit that controls operation of the suction mechanism based on a value of atmospheric pressure detected by the atmospheric pressure detection unit, wherein the atmospheric pressure detection unit is disposed at a location that is outside the transport path and that is higher than the transport path.

According to Technical Idea 1, since the atmospheric pressure detection unit is disposed outside the transport path, undesirable matter, such as mist of small particles produced due to ejection of the liquid and dust and dirt that fly off due to transport of the medium, is less likely to adhere to the vent. Therefore, the influence of undesirable matter on atmospheric pressure detection can be reduced.

Technical Idea 2

The liquid ejecting apparatus according to Technical Idea 1, wherein the atmospheric pressure detection unit is disposed so that an opening of the vent faces toward an outside of the transport path.

According to Technical Idea 2, undesirable matter that flies outward from inside the transport path is less likely to enter the vent, so that the influence of undesirable matter on atmospheric pressure detection can be reduced.

Technical Idea 3

The liquid ejecting apparatus according to Technical Idea 1 or Technical Idea 2, further including a casing that has an exhaust opening and that houses the liquid ejecting head and the atmospheric pressure detection unit, and an exhaust fan that sends a gas out from inside the casing through the exhaust opening, wherein, within the casing, the atmospheric pressure detection unit is disposed at a location that is farther apart from the exhaust opening than the exhaust fan is.

According to Technical Idea 3, the atmospheric pressure detection unit is disposed at a location apart from the exhaust opening. Therefore, when the exhaust fan is not in operation, undesirable matter entering the casing through the exhaust opening is less likely to adhere to the vent. Furthermore, in the case were the atmospheric pressure detection unit is disposed at the gas inlet side of the exhaust fan, undesirable matter adhering to the atmospheric pressure detection unit and the vicinity thereof can be removed by operating the exhaust fan.

Technical Idea 4

The liquid ejecting apparatus according to any one of Technical Ideas 1 to 3, further including a casing that has a introducing port for introducing the medium and a discharging port for discharging the medium and that houses the liquid ejecting head and the atmospheric pressure detection unit, wherein the atmospheric pressure detection unit is disposed at a location that is nearer to the discharging port than to the introducing port.

According to Technical Idea 4, even when gas flow that moves from the introducing port toward the discharging port due to transport of the medium brings in undesirable matter through the introducing port, the undesirable matter is less likely to adhere to the vent since the atmospheric pressure detection unit is disposed at a location near the discharging port. Furthermore, undesirable matter adhering to the atmospheric pressure detection unit can be removed by gas flow moving out of the casing through the discharging port.

Technical Idea 5

The liquid ejecting apparatus according to any one of Technical Ideas 1 to 4, further including a casing that has a discharging port for discharging the medium and an exhaust opening and that houses the liquid ejecting head and the atmospheric pressure detection unit, and an exhaust fan that sends a gas out from inside the casing, wherein the exhaust opening and the atmospheric pressure detection unit disposed on one side and another side across the transport path.

According to Technical Idea 5, when gas drawn into the casing through the introducing port and the discharging port by operating the exhaust fan is sent out through the exhaust opening, gas flow moving from the introducing port and the discharging port toward the vent occurs in an area in the casing which is at one side of the transport path. Therefore, the atmospheric pressure detection unit, which is disposed at the opposite side of the transport path at which this gas flow does not occur, is less subject to influence of undesirable matter contained in external gas.

Technical Idea 6

The liquid ejecting apparatus according to any one of Technical Ideas 1 to 5, wherein the atmospheric pressure detection unit is disposed in such a posture that an opening of the vent faces downward.

According to Technical Idea 5, falling undesirable matter is less likely to adhere to the vent. Furthermore, since undesirable matter adhering to or near the vent can fall, fixture of undesirable matter to the vent is inhibited.

Technical Idea 7

The liquid ejecting apparatus according to any one of Technical Ideas 1 to 6, further including a cover that covers the atmospheric pressure detection unit.

According to Technical Idea 7, since the cover blocks undesirable matter, adhesion of undesirable matter to the vent is inhibited.

Technical Idea 8

The liquid ejecting apparatus according to any one of Technical Ideas 1 to 7, wherein the control unit changes an operating time of the suction mechanism based on a value of atmospheric pressure detected by the atmospheric pressure detection unit.

According to Technical Idea 8, suction can be appropriately performed according to the atmospheric pressure at the time of use.

The entire disclosure of Japanese Patent Application No. 2016-175294 filed Sep. 8, 2016 is expressly incorporated by reference herein.

What is claimed is:

1. A liquid ejecting apparatus comprising:

a liquid ejecting head that performs recording by ejecting a liquid to a medium transported along a transport path;

a suction mechanism that sucks an interior of the liquid ejecting head;

an atmospheric pressure detection unit that has a vent for communication with an atmosphere and that detects atmospheric pressure; and a control unit that controls operation of the suction mechanism based on a value of atmospheric pressure detected by the atmospheric pressure detection unit, wherein the atmospheric pressure detection unit is disposed at a location that is outside the transport path and that is higher than the transport path, wherein the vent opens in a direction away from the transport path.

2. The liquid ejecting apparatus according to claim 1, further comprising:

a casing that has an exhaust opening and that houses the liquid ejecting head and the atmospheric pressure detection unit; and an exhaust fan that sends a gas out from inside the casing through the exhaust opening, wherein, within the casing, the atmospheric pressure detection unit is disposed at a location that is farther apart from the exhaust opening than the exhaust fan is.

3. The liquid ejecting apparatus according to claim 1, further comprising a casing that has a introducing port for introducing the medium and a discharging port for discharging the medium and that houses the liquid ejecting head and the atmospheric pressure detection unit, wherein the atmospheric pressure detection unit is disposed at a location that is nearer to the discharging port than to the introducing port.

4. The liquid ejecting apparatus according to claim 1, further comprising:

a casing that has a discharging port for discharging the medium and an exhaust opening and that houses the liquid ejecting head and the atmospheric pressure detection unit; and an exhaust fan that sends a gas out from inside the casing through the exhaust opening, wherein the exhaust opening and the atmospheric pressure detection unit disposed on one side and another side across the transport path.

5. The liquid ejecting apparatus according to claim 1, wherein the atmospheric pressure detection unit is disposed in such a posture that an opening of the vent faces downward.

6. The liquid ejecting apparatus according to claim 1, further comprising a cover that covers the atmospheric pressure detection unit.

7. The liquid ejecting apparatus according to claim 1, wherein the control unit changes an operating time of the suction mechanism based on a value of atmospheric pressure detected by the atmospheric pressure detection unit.

8. A liquid ejecting apparatus comprising:

a liquid ejecting head that performs recording by ejecting a liquid to a medium transported along a transport path;

a suction mechanism that sucks an interior of the liquid ejecting head;

an atmospheric pressure detection unit that has a vent for communication with an atmosphere and that detects atmospheric pressure; and a control unit that controls operation of the suction mechanism based on a value of atmospheric pressure detected by the atmospheric pressure detection unit, wherein the atmospheric pressure detection unit is disposed at a location that is outside the transport path and that is higher than the transport path, wherein the vent opens downward.

9. The liquid ejecting apparatus according to claim 8, further comprising:

a casing that has an exhaust opening and that houses the liquid ejecting head and the atmospheric pressure detection unit; and an exhaust fan that sends a gas out from inside the casing through the exhaust opening, wherein, within the casing, the atmospheric pressure detection unit is disposed at a location that is farther apart from the exhaust opening than the exhaust fan is.

10. The liquid ejecting apparatus according to claim 8, further comprising a casing that has a introducing port for introducing the medium and a discharging port for discharging the medium and that houses the liquid ejecting head and the atmospheric pressure detection unit, wherein the atmospheric pressure detection unit is disposed at a location that is nearer to the discharging port than to the introducing port.

11. The liquid ejecting apparatus according to claim 8, further comprising:

a casing that has a discharging port for discharging the medium and an exhaust opening and that houses the liquid ejecting head and the atmospheric pressure detection unit; and an exhaust fan that sends a gas out from inside the casing through the exhaust opening, wherein the exhaust opening and the atmospheric pressure detection unit disposed on one side and another side across the transport path.

12. The liquid ejecting apparatus according to claim 8, further comprising a cover that covers the atmospheric pressure detection unit.

13. The liquid ejecting apparatus according to claim 8, wherein the control unit changes an operating time of the suction mechanism based on a value of atmospheric pressure detected by the atmospheric pressure detection unit.

14. A control method of a liquid ejecting apparatus including a liquid ejecting head that performs recording by ejecting a liquid to a medium transported along a transport path, a suction mechanism that sucks an interior of the liquid ejecting head, an atmospheric pressure detection unit that has a vent for communication with an atmosphere and is disposed at a location that is outside the transport path and that is higher than the transport path, the control method comprising:

detecting atmospheric pressure by the atmospheric pressure detection unit; and changing an operating time of the suction mechanism based on a value of atmospheric pressure detected by the atmospheric pressure detection unit.

* * * * *